US005259135A

United States Patent [19]

Bannister et al.

[11] Patent Number: 5,259,135

[45] Date of Patent: Nov. 9, 1993

[54] DISPLAY DEVICE

[75] Inventors: Brian C. Bannister, North Mymms; James N. Morgan, St. Albans, both of England; Simon A. Rivers-Bland; David Duncan, both of London, United Kingdom

[73] Assignee: Marler Haley Exposystems Limited, Hatfield, United Kingdom

[21] Appl. No.: 650,562

[22] Filed: Feb. 1, 1991

[30] Foreign Application Priority Data

Feb. 2, 1990 [GB] United Kingdom ..... 9002410

[51] Int. Cl.[5] ..... G09F 11/02

[52] U.S. Cl. ..... 40/503; 40/504; 40/305

[58] Field of Search ..... 40/503, 504, 505

[56] References Cited

U.S. PATENT DOCUMENTS

| | | | |
|---|---|---|---|
| 676,396 | 6/1901 | Heinemann | 40/505 |
| 1,637,579 | 8/1927 | Long | 40/505 |
| 3,304,638 | 2/1967 | Grandell et al. | 40/505 |
| 3,383,785 | 5/1968 | Werner | 40/505 |

FOREIGN PATENT DOCUMENTS

| | | |
|---|---|---|
| 0162254 | 11/1985 | European Pat. Off. . |
| 0249396 | 12/1987 | European Pat. Off. . |
| 2602898 | 2/1988 | European Pat. Off. . |

*Primary Examiner*—Kenneth J. Dorner
*Assistant Examiner*—Cassandra Hope Davis
*Attorney, Agent, or Firm*—Hodgson, Russ, Andrews, Woods & Goodyear

[57] ABSTRACT

An improved mode of construction is provided for a display device of the kind comprising an array of triangular-section slats rotated in synchronism in 120° steps to present repeatedly to view, in sequence, three compound display surfaces, each carrying a respective poster or the like. In embodiments of the invention, each slat has a respective bearing and driving module with a respective rotary member releasably drivingly engaging the slat and with a respective cam, driving the rotary member and driven in turn by a driving shaft, passing through the cams of the bearing and driving modules of all of the slats. The bearing and driving modules are received in a stack within a hollow extrusion which forms one side member of a frame of the display device. The opposite side member of the frame receives a stack of bearing members rotatably supporting the opposite ends of the respective slats.

7 Claims, 8 Drawing Sheets

Figure 1:
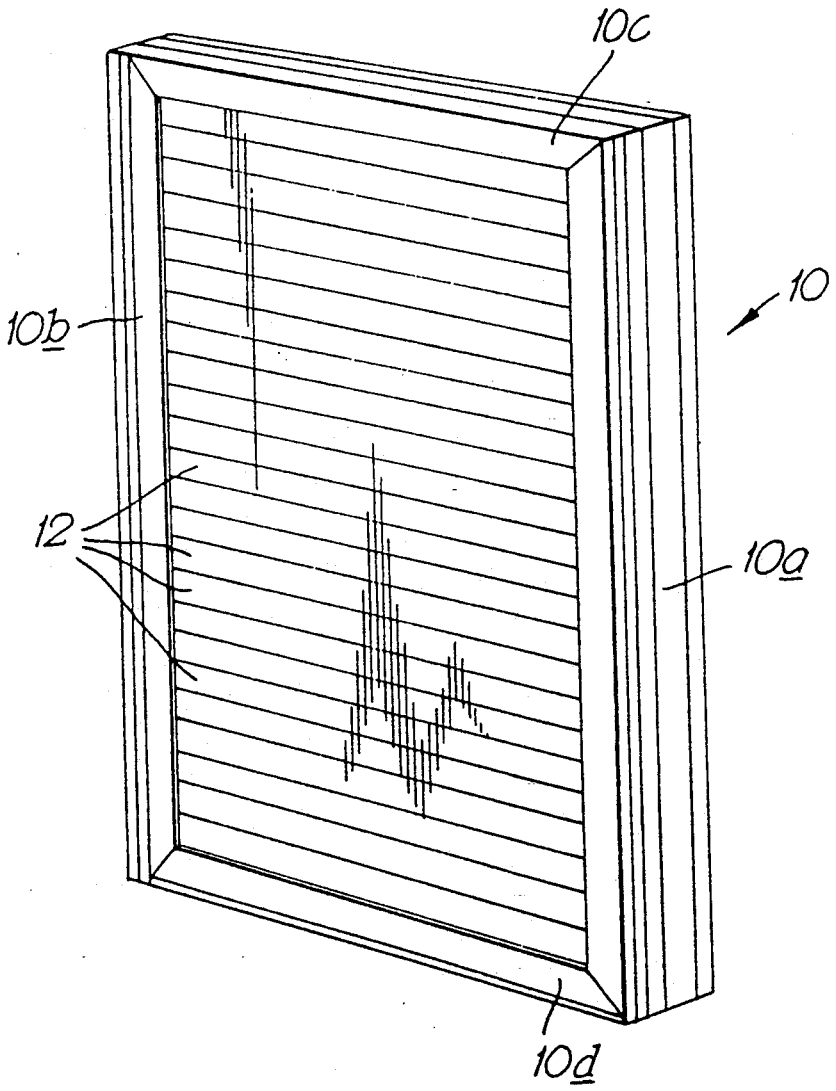

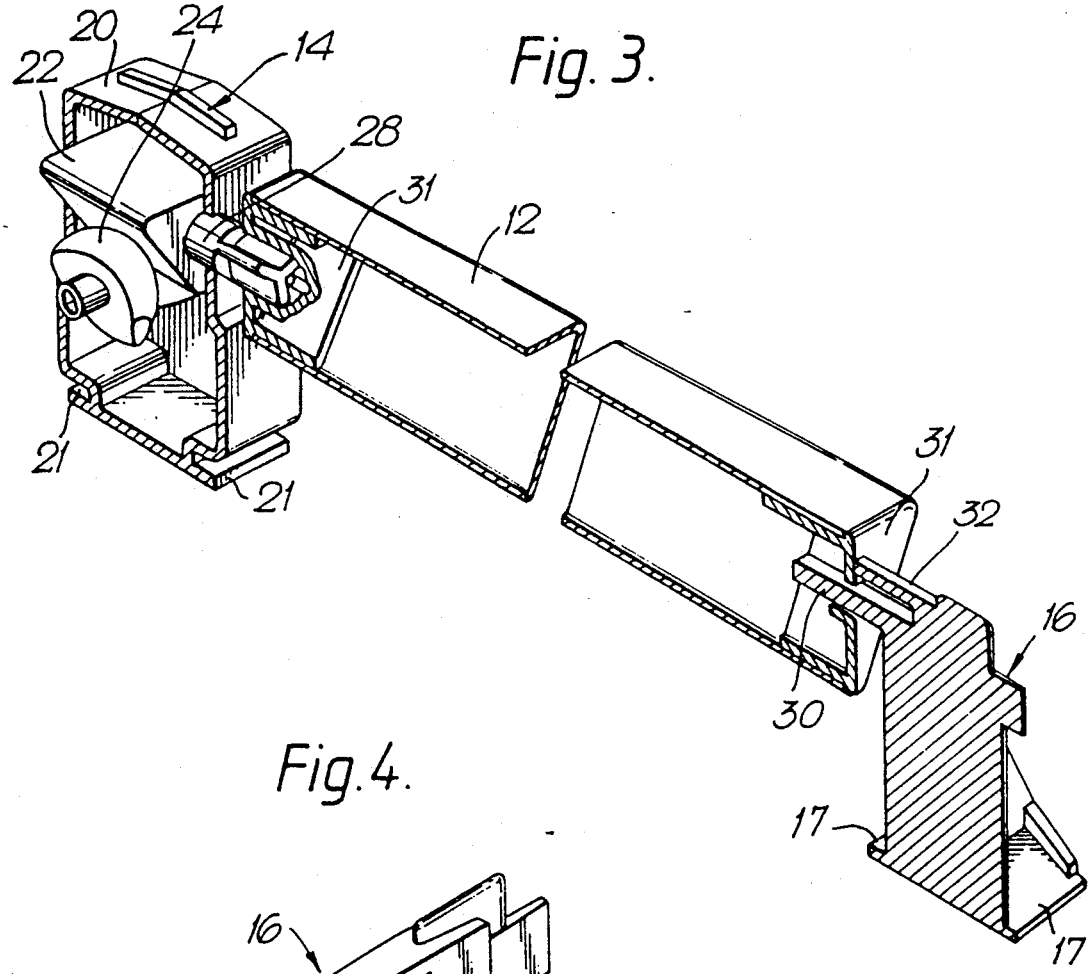
Fig. 3.
Fig. 4.
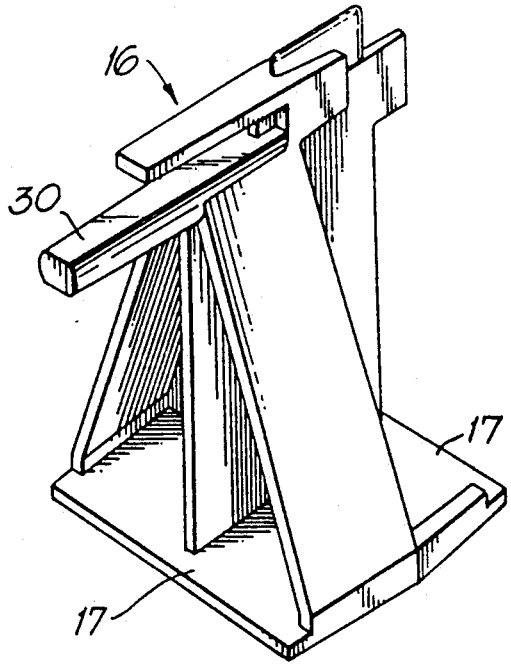

DISPLAY DEVICE

This invention relates to display devices of the kind comprising an array of slats of triangular section which are rotated in synchronism in 120° steps so as to present to view, in a repeating cycle, comprising three display phases, three compound display surfaces, each presented to view during a respective one of said display phases, each such compound surface being formed by the aggregate of the respective individual flat surfaces of the slats, whereby three different advertising posters, for example, can be presented to view, in succession in the same display space, a different one of the three posters or the like being presented to view, after each 120° rotational step. Display devices of the above kind are herein referred to as being 'of the kind specified'.

Display devices of the kind specified have hitherto been relatively expensive to manufacture because the construction hitherto adopted has involved the assembly of the various parts in an inner chassis and has required skilled labour for such assembly. Such assembly has required careful fitting and adjustment of a large number of individual parts and thus has been expensive and labour intensive. Furthermore, the requirement for an inner chassis, which is subsequently fitted within a more aesthetically acceptable outer frame has, in the known devices, added to the weight of the device as well as to the cost of manufacture.

It is an object of the present invention to provide an improved display device of the kind specified whereby these disadvantages can be avoided.

According to one aspect of the invention there is provided a display device of the kind specified wherein each slat is supported at one end thereof by a respective combined bearing and driving module each comprising a respective housing, a respective driving member or cam rotatably mounted in the housing, a respective driven member rotatably mounted in the housing and having coupling means whereby the driving member or cam can be connected directly or indirectly with a driving motor, said combined bearing and driving modules being readily assembled into the support structure of the device, the arrangement being such that the slats can be individually fitted or removed from the assembled device by releasing the slats from their respective combined bearing and driving modules, without significantly disturbing the remainder of the assembly.

According to another aspect of the invention there is provided a kit of parts comprising a peripheral framework of hollow members, a plurality of triangular-section slats, bearing members for the one ends of said slats, such bearing members being adapted to be mounted in one of said hollow members, and combined bearing and driving modules for the other ends of said slats, such modules being adapted for mounting in an opposite one of said hollow members.

According to yet another aspect of the invention there is provided a display device of the kind specified wherein each slat is supported at one end thereof by a respective bearing and driving means including a respective rotatable driven member having a non-circular engagement formation for engagement with a complementary formation of an assembly carried by the slat at the end thereof, said assembly including a rotatable plug and clutch means allowing rotational adjustment of the plug relative to the slat between predetermined angular positions.

Figure 2:
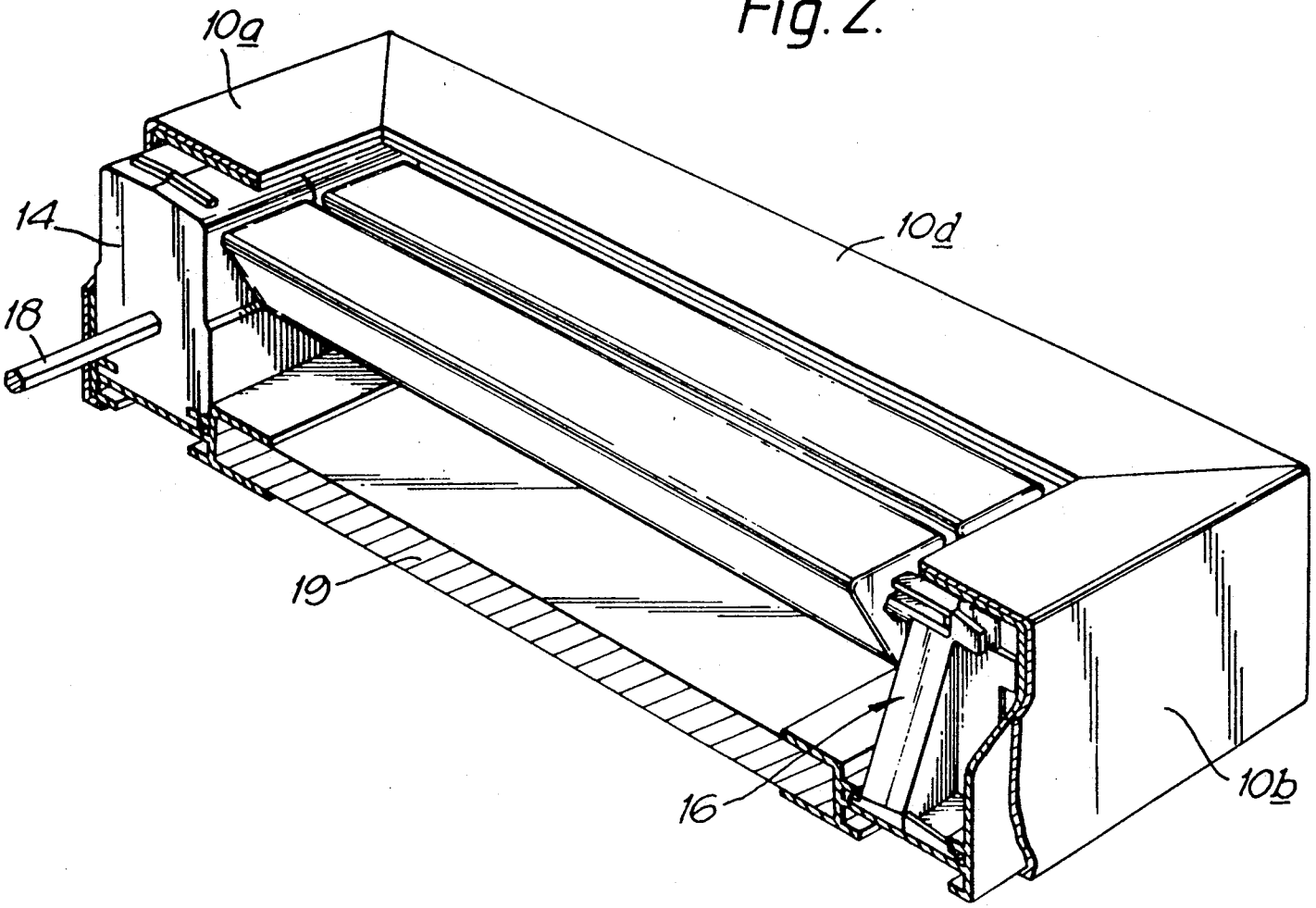
Figure 2A:
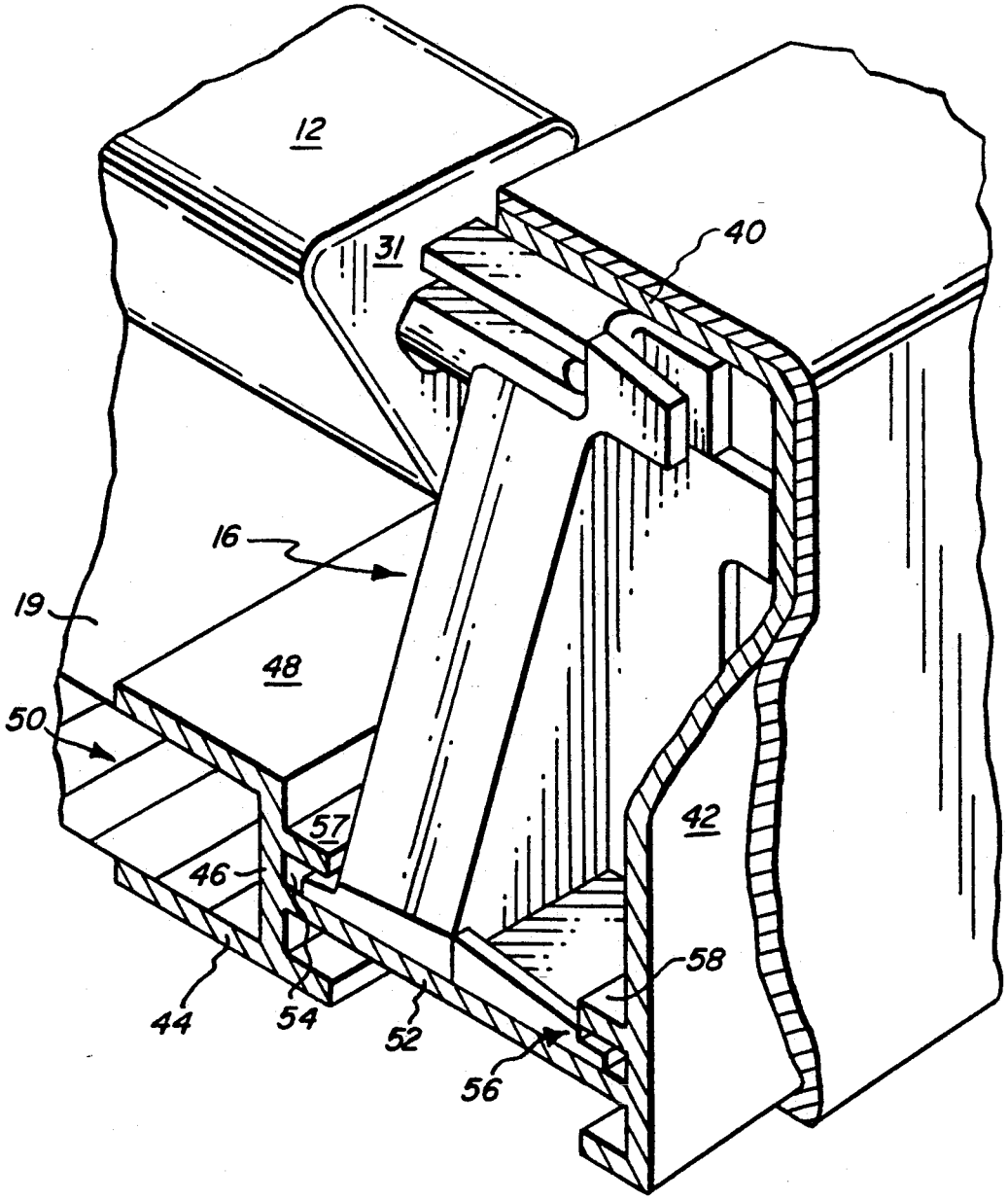
Figure 5:
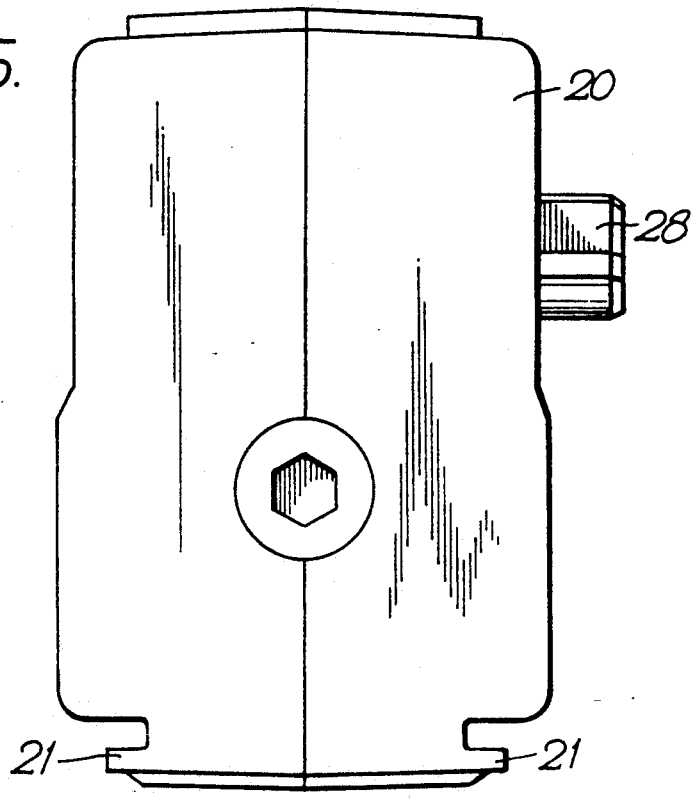
Figure 6:
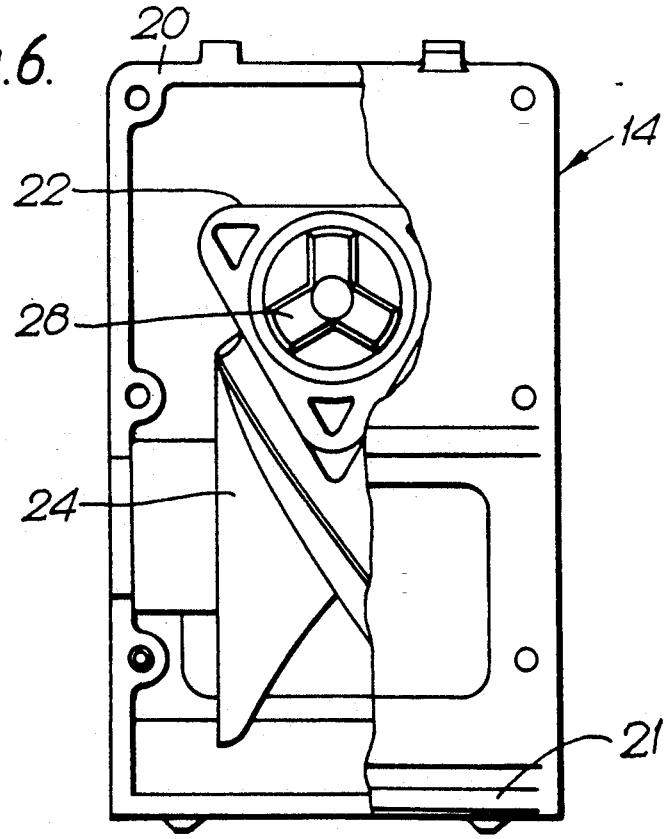
Figure 7:
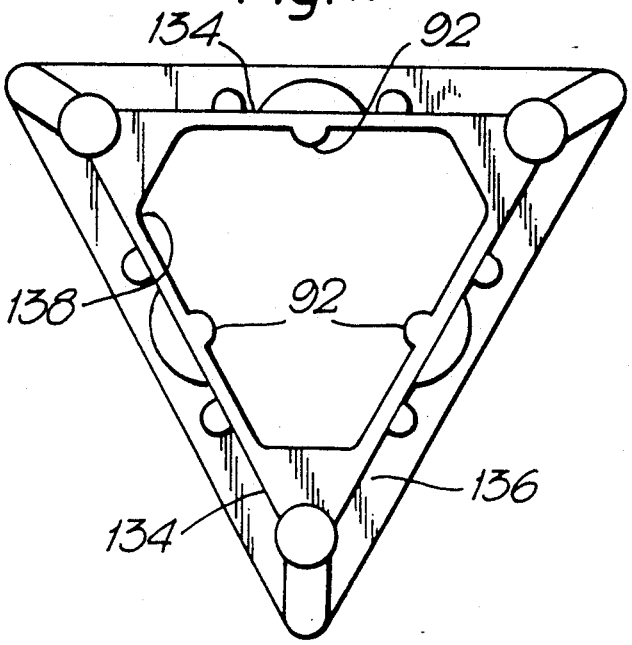
Figure 8:
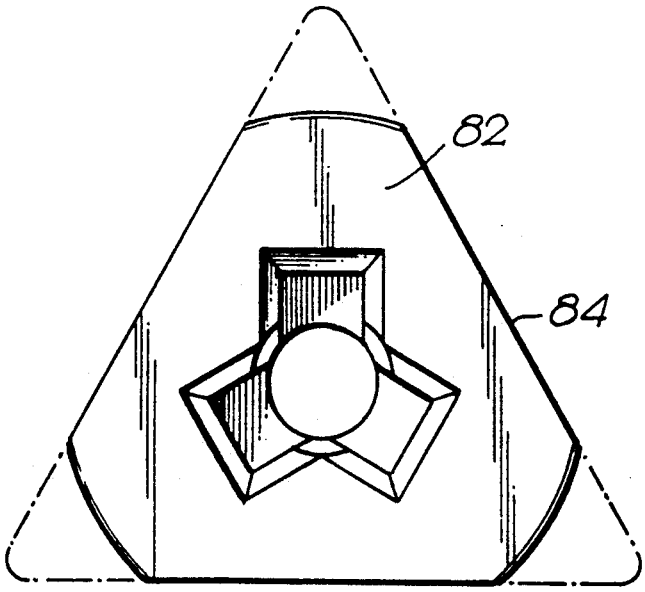
Figure 9:
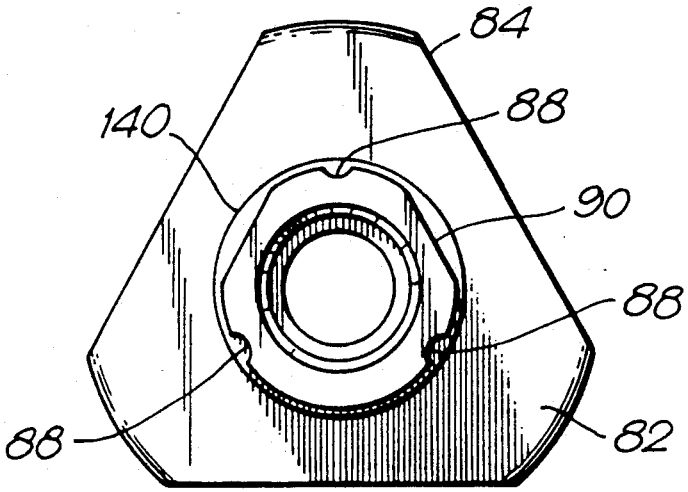
Figure 10:
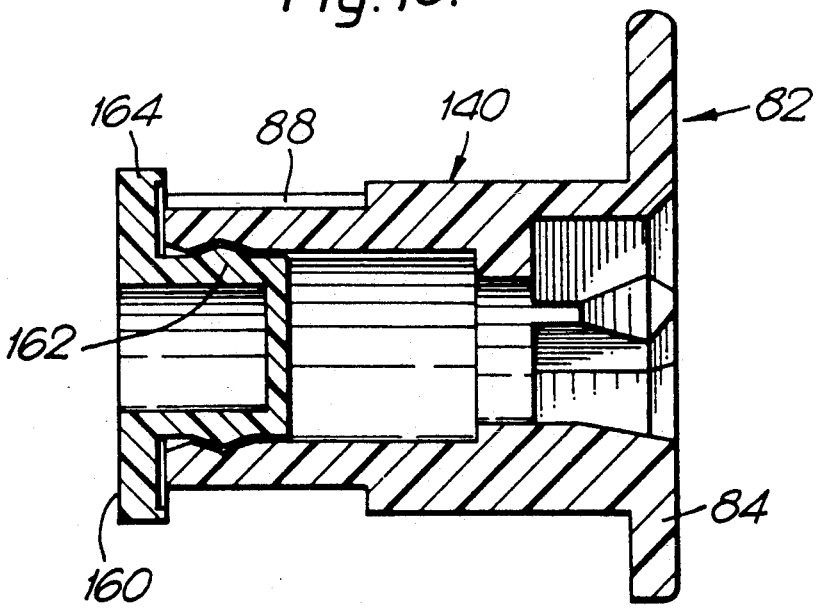
Figure 11:
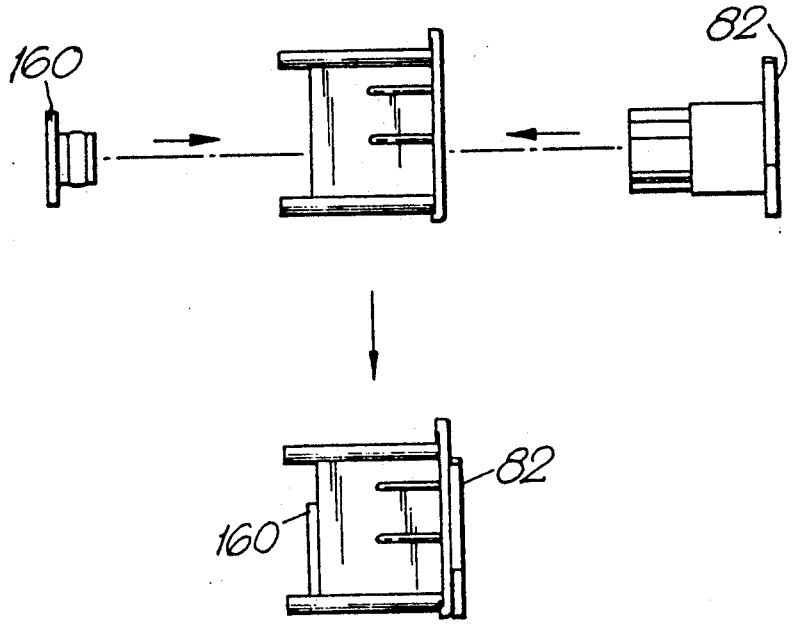
Figure 12:
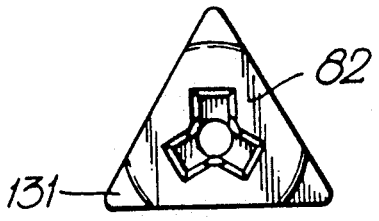
Figure 13:
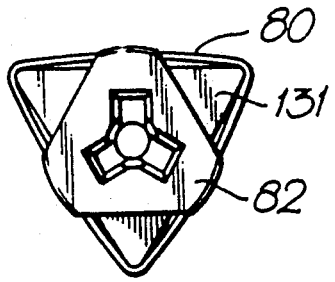

An embodiment of the invention is described below by way of example with reference to the accompanying drawings in which:

FIG. 1 is a perspective view of a display device embodying the invention,

FIG. 2 is a partial, fragmentary, partially sectioned view showing part of the display device of FIG. 1, FIG. 2*a* is an enlarged view of a portion of FIG. 2, FIG. 3 is a fragmentary perspective view showing still further details of the device of FIGS. 1 and 2, FIG. 4 is a perspective view showing the construction of an end bearing member both forming part of the display device, FIG. 5 is a view, from above, of a bearing and driving module, FIG. 6 is a view, partly broken away, to show internal details, from the right hand side in FIG. 5, FIG. 7 is an end elevation view of an end cap for a slat of the display device, FIGS. 8 and 9 are views from opposite ends of an outer end cap plug, FIG. 10 is an axial section view of the outer end cap plug with an inner end plug fitted therein, FIG. 11 is a schematic view illustrating the assembly of the end cap of FIG. 7 with the outer end cap plug and the inner end plug, FIG. 12 is an end view of a slat fitted with the assembled end cap end plug in one position, and FIG. 13 is a view similar to FIG. 12 but showing an outer sleeve fitted to the slat and the outer end cap plug rotated into another position.

Referring to FIG. 1, the display device of the invention comprises, in common with known display devices of the kind specified, a peripheral rectangular frame 10 within which is mounted an array of contiguous parallel slats 12 which, in any of the three display phases of the device, in which the slats 12 are substantially stationary, together define a planar outwardly directed vertical display surface. As in the known display devices of the kind specified, each of the individual slats 12 has, in cross section, the form of an equilateral triangle, the slats being supported at their ends for rotation, in the frame 10, about their respective longitudinal axes and being arranged to be rotated in 120° steps by a drive system described below.

The frame 10 comprises two opposing vertical members 10*a* and 10*b* and an upper and a lower horizontal member 10*c*, 10*d* respectively, each of said members being an extrusion (for example of aluminium alloy) of approximately U-shaped or J-shaped cross section with the open sides of the sections in opposing frame members facing towards each other across the frame. The vertical frame member 10*a* houses means for supporting the individual slats 12 at their one ends and for driving the slats, whilst the vertical member 10*b* houses means for rotatably supporting the opposite ends of the slats 12. Thus, for each slat 12, there is provided, accommodated within the side member 10*a* of the frame, (FIG. 2) a respective bearing and driving module 14, supporting one end of the slat and, accommodated in the opposite side member 10*b*, a respective bearing member 16 supporting the opposite end of the slat. A single driving shaft 18, of hexagonal cross-section, extends vertically within the side member 10*a* through the modules 14 to a driving motor (not shown) mounted in the lower horizontal member 10*d*. The continuous rotation of the driving shaft 18 produces the synchronised step-wise rotation of the slats 12, as in known display devices of the kind specified.

Referring to FIG. 3, each module 14 comprises an approximately rectangular housing or casing 20 within which are rotatably mounted, a driven member 22 and a driving member or cam 24. The member 22 is mounted for rotation about a horizontal axis corresponding with the longitudinal axis of the respective slat 12, and includes a body part having, in cross section, the form of an equilateral triangle and, extending from opposite ends of the body part of the driven member 22, along said horizontal axis, respective spigots 28 which extend through respective circular holes in the opposing walls of the casing 20 which holes thereby afford bearings for the member 22. Only the spigot (referenced 28) adjacent the slat 12 is shown in FIG. 3. At its free end, remote from the body part 22, the spigot 28 has a non-circular tri-axially symmetrical form for engagement in a recess, of complementary form, in an end cap 31 of the slat 12, whereby the slat 12 is constrained to rotate with the body part 22. The end faces of the triangular body part cooperate with the inner faces of the respective walls of the casing 20 to locate the member 22 axially. The driving member or cam 24 is mounted for rotation about a vertical axis, and comprises a body of complex form terminating in opposite end faces which cooperate with the inner surfaces of the upper and lower walls of the casing 20 and from which end faces project respective short externally cylindrical spigots which extend, as a close fit, through respective circular apertures in the upper and lower walls of casing 20 which apertures thus form bearings for the cam 24. A vertical passage extends through the cam 24 along the axis of the spigots of the latter, which are thus of hollow or annular form, said passage being, over part of its length, of hexagonal cross section complementary to the hexagonal cross-section of shaft 18, which extends through said passage in the assembled device, whereby the cam 24 is constrained to rotate with the shaft 18. The form of the body part of the cam 24 is, as regards its operative surface and principle of operation, substantially the same as that used in known display devices of the type specified, in which, for each triangular-section slat a respective cam corresponding in form with the cam 24, cooperates directly with the end of the respective triangular section slat, which triangular end part of the slat effectively forms a cooperating cam or gear so that during one complete rotation of the cam corresponding to cam 24, the slat makes one 120° rotational step, followed by a relatively protracted pause, whereby the slat makes one complete rotation, in three steps, with interspersed pauses for every 3 rotations of the shaft, during continuous rotation of the latter. Thus the device of the preferred embodiment operates in exactly the same way as the known device referred to but utilises the separately formed driven member 22 instead of the end of the slat 12 itself.

The rear wall of the casing 20 has a foot portion projecting slightly rearwardly therefrom which carries lateral flanges 21 on opposite sides, for a purpose explained below.

Likewise, the bearing member 16 has a mounting plate at the rear which affords lateral flanges 17.

The bearing members 16 are preferably in the form of integral injection mouldings in suitable plastics. The members 22 and 24 are likewise preferably integral injection moulded plastics items, whilst each casing 20 may be formed as two complementary injection moulded shells fitted together along a parting line which bisects the bearing holes for the spigots of cam 24, around the members 22 and 24.

The bearing member 16 which supports the opposite end of the slat 12 is a unitary member affording an axial spigot 30 which projects through a central aperture in the end cap 31 at the opposite end of the slat 12 to support that end of the slat 12 for rotation about its axis. The bearing member 16 also has an integral leaf-spring 32, an end portion of which extends substantially parallel with the spigot 30 and the free end of which, in the normal, assembled condition of the display device, closely adjoins the end face of the respective end cap 31 and acts as a stop to limit axial movement of the slat 12 away from the respective bearing module 14. However, the spring 32 can be depressed manually, towards the spigot 30 to engage in a recess in the end face of the end cap 31 which is of sufficient depth to allow enough axial displacement of the slat 12 to permit the spigot 28 of the respective module 14 to fully clear the end cap 31 at the end of the slat adjoining that module 14, whereafter the end of the slat 12 adjoining that bearing module 14 can be swung away from the bearing module to clear the spigot 28, allowing subsequent axial displacement of the slat 12 in the opposite direction to extract the spigot 30 of the bearing member 16 from the opposite end cap 31 whereafter the slat may be withdrawn from the device.

To reduce manufacturing costs, and to facilitate assembly, the same pattern of end cap may be used at each end of each slat. In an simple form, such an end cap may be a unitary body having outer side walls which lie on the inside of and engage, the inner surfaces of the three side walls of the slat 12 when the end cap is fitted, the end cap further having a central circular bearing hole surrounded by a generally Y-shaped tri-axially symmetrical recess which serves to receive the correspondingly shaped end of spigot 28 when installed at the end adjoining side member **10*a* and to receive the end of leaf spring 32, when the latter is depressed, when the end cap is installed at the opposite end of a slat 12**.

As may be seen from FIG. **2*a*, the vertical members 10*a*, 10*b* formed as aluminium alloy extrusions having the constant cross-section shown, afford a front wall 40, an outer side wall 42 and a rear wall 44. A web 46 extends forwardly from the rear wall and a flange 48 extends from the forward edge of the web 46, in the direction away from the outer wall 42 to form, with the free edge portion of the rear wall 44, a channel 50 to receive an edge portion of a rectangular backboard 19 (FIG. 2). From the side of web 46 nearer the wall 42 extend a ribs 57, defining, with wall 52, a slot 54. An opposing slot 56 is defined between wall 52 and rib 58 extending from the outer wall 42 towards the web 46. The slots 54 and 56 receive the flanges 21 provided on the modules 14 (in the case of member 10*a*), and the flanges 17 of the members 16 (in the case of member 10*b*) to locate the modules 14 within the member 10*a* and the members 16 within the member 10*b***.

In assembly of the device, the side members **10*a* and 10*b* an the lower horizontal member 10*d* are secured along respective edges of the appropriately dimensioned backboard 19. A motor unit (not shown) is fitted in the lower horizontal member, the motor being connected with a hexagonal-section metal driving shaft 18 extending vertically within the respective member 10*a* and having an upper, free end adjacent the upper end of the member 10*a*. A series of identical modules 14 is now fitted within the member 10*a*** accommodating the shaft 18, the modules 14 being slid in succession over the shaft 18 so that the latter passes through the hexagonal-section internal passages through the cams 24 and so that the two flanges 21 of each module casing 20 are engaged in the respective opposed slots 54, 56. The first module 14 inserted is slid along the slots 54, 56 until the respective spigot of its cam 24 engages a stop on the driving shaft 18 and the succeeding modules 14 are each slid down towards the lower horizontal member 10*d* until they abut the previously inserted module 14. Likewise the first member 16 inserted in the opposite vertical member 10*b* is slid downward towards the lower horizontal member until it engages an appropriate stop (not shown) and succeeding members 16 are likewise slid down the member 10*b* until each engages the previously inserted member 16. The top horizontal member 10*c* may then be secured holding the modules 14 and members 16 in place and the slats 12 can then be inserted in the unit from the front, by first engaging one end of each slat with a respective member 16 so that the spigot 30 of the member 16 enters the bearing hole in the respective end cap 31, the respective leaf spring 32 depressed using, for example, a screw driver or the like narrow instrument, until the end of the spring 32 can engage in one of the recesses in the end cap 31, allowing the slat 12 to be displaced longitudinally towards the respective member 16 sufficiently to allow the opposite end cap 31 to clear the respective spigot 28, after which an axial movement of the slat in the opposite direction will engage the non-circular formation at the end of the spigot 28 with the complementary non-circular recess in the end cap 31, thereby connecting the slat 12 non-rotatably with respect to the member 22. The last-noted axial displacement of the slat 12 will also allow the leaf spring 32 to spring out of its recess in the opposite end cap 31 whereby the free end of the leaf spring 32 will act as a stop to prevent sufficient axial movement of the slat 12 away from the respective module 14 to disengage the slat 12 from the respective spigot 28.

The device according to the invention has the advantage that, since the modules 14 and members 16 are supported directly in the same hollow members as afford the exterior of the frame, no internal chassis is required, minimising cost and weight. Furthermore, the assembly of the modules 14 and members 16 in the frame and the insertion, thereafter, of the slats 12, requires neither special tools nor equipment nor any particular skill since little more is involved than merely sliding the components into place. Furthermore, given the requisite extrusions of the cross section required for the horizontal and vertical members 10*a*, 10*b* and for the slats 12 and hexagonal section rod stock for the driving shaft 18, constructing a display unit to any desired size involves little more than cutting the respective extrusions and rod to the appropriate length, cutting a backboard to the appropriate size and fitting the requisite number of prefabricated members 16 and modules 14 in place. Consequently, the assembly of display devices embodying the invention according to non-standard sizes represents no difficulty. Furthermore, assembly is so straightforward that it is practical to ship such display devices to customers in disassembled form with simple instructions for assembly, allowing unskilled assembly by the customers. Indeed, it would be possible to supply the device in the form of a kit of parts, comprising lengths of the respective extrusions for the slats 12, members 10*a*, 10*b*, 10*c* and 10*d*, modules 14, members 16, end caps 31, shaft 18 and motor, and the various fixtures and fasteners required, allowing the purchaser to cut the extrusion to the necessary lengths for any particular size of display device and thereafter assemble the device, or alternatively to construct without the need for cutting to size, a display from a kit incorporating extrusions, etc. already cut to size. The modules 14, of course, are preferably supplied already fully assembled.

The straightforward manner of removal and replacement of the slats 12 without requiring disassembly of the rest of the device makes it a simple matter to remove the slats when required for cleaning, to remove the respective strips of old posters and to apply the respective individual strips of the new poster to be displayed and to replace the slats 12 in the frame 10.

In a preferred variant of the display device so far described, each slat 12 is provided with a transparent plastics sleeve 80, (FIG. 13) of generally triangular section, which fits over the slat 12 with just enough clearance to accommodate, between each side of the slat and the adjacent side of the sleeve, the respective poster strip or the like bearing the appropriate part of the respective image to be displayed. In this embodiment, each sleeve 80 extends over substantially the whole length of the slat and is retained on the slat by end cap plugs 82, as explained below, each end cap plug 82 being fitted within a respective slat end cap 131, shown in FIG. 7 which, like the end cap 31, has a stub portion of hollow rectangular triangular section, defined by three side walls 134, which is a close fit in the end of the respective slat 12, and which walls 134 terminate in an end wall 136, perpendicular to said walls 134, pierced by a central aperture 138 of the form shown. The aperture 138 receives, without radial play, a shank portion 140 of the respective end cap plug 82, which extends axially within the end cap 131 and the slat 12 and is, subject to the constraints referred to below, rotatable, about the slat axis, in the end cap 131. The outer end of the end cap plug 82 is provided by a flat head 84 perpendicular to the axis of the end cap 131 and of the slat 12 receiving the cap 131. Extending through the head 84 from the outer face thereof, and into the outer part of the shank portion 140, is a Y-shaped recess which exhibits triaxial symmetry and is of the same form as that provided in the end cap 31 described above and is thus similarly complementary with, and intended to receive, the end of a spigot 28 or of a leaf spring 32.

Said Y-shaped recess in the end cap plug 82 likewise opens into an axial central bore adapted to receive the spigot 30 of a bearing member 16.

As shown in FIGS. 9, 12 and 13, the profile of the flat head 84 of the end cap plug is substantially that of an equilateral triangle of the same size as that afforded, in cross section, by the outer periphery of the slat 12, but with the vertices of the triangle rounded off.

The part of the shank portion 140 further from the flat head has, at 120° intervals therearound, longitudinally extending grooves 88 of part-circular cross-section and, interposed regularly between the grooves 88, three flats or facets 90, parallel with the axis of the shank portion.

The grooves 88 and facets 90 cooperate with longitudinally extending ribs 92 which project from the inner sides of respective ones of the three side walls 134 of the end cap 131 (see FIG. 7) so as to be spaced at 120° angles from one another about the central axis of the end cap 131 and slat 12. Thus, in each of three angular positions, 120° degrees apart, of the end cap plug, with respect to the end cap 131, about the central axis of the latter, said ribs 92 engage in respective ones of the grooves 88 to restrain the end cap plug from rotating in the end cap. Such a position of the end cap plug is shown in FIG. 13. The components are sufficiently resilient, however, to allow the ribs 92 to spring out of the grooves 88 when the end cap plug is rotated forcibly, whereby the end cap plug can be rotated through 60° to a position in which the ribs 92 lie on the outer sides of the flats 90. Such a position of the end cap plug is shown in FIG. 12. The arrangement of ribs 92, grooves 88 and flats 90 thus forms a species of clutch allowing angular adjustment of the end cap plug relative to the end cap. In the position of the end cap plug shown in FIG. 12, the flat head of the end cap plug does not project radially outwardly beyond the slat 12, so that a sleeve 80 can readily be slid onto or slid off the slat and/or image strips inserted into and removed from the spaces between the sides of the slat 12 and the sides of the sleeve 80. In the position of the end cap plug illustrated in FIG. 13, on the other hand, the three "apices" of the flat head 84 project sufficiently beyond the sides of the slat 12 and the sleeve 80 to ensure that the sleeve 80 and any image strips interposed between the slat 12 and the sleeve 80, are held reliably in place. The adjustability afforded by the aforesaid "clutch" also makes it simple to adjust the slats to the correct angular orientation when fitting the slats in place, for example after applying new image strips.

The end cap plug 82 is held captive in the end cap 131 by an inner end plug 160 which, like the end cap plug 82, is of resilient synthetic plastics material and comprises a generally cylindrical axial stem 162 having an enlarged circular head 164 at one end.

New poster strips can readily be fitted to a slat incorporating the sleeve and end-plug arrangement described by rotating one end plug cap to the position shown in FIG. 12, sliding off the transparent plastics sleeve, removing the old poster strips, applying the new poster strips, sliding the transparent sleeve back on, over the new poster strips and finally rotating the end plug cap to the position shown in FIG. 13.

To facilitate application of new poster strips further, short pieces of double-sided adhesive tape may be applied to the three lateral surfaces of each slat at one end thereof and the poster strips fitted by applying the appropriate ends of the poster strips to the adhesive-taped parts of the slat in the correct orientation and registry and subsequently sliding the transparent sleeve onto the slat, from the adhesive-taped end, over the new poster strips to hold the latter in place.

In assembly, as illustrated in FIGS. 10 and 11, the shank portion of the end cap plug is inserted through the central aperture 138 of the end cap 131 from the outer end of the latter and the stem 162 of the inner end plug is inserted, from the inner end of the end cap 131 into the inner end of an axial bore in the shank portion 140. The stem 162 has a circumferential external annular rib which enters into snap engagement with a circumferential internal annular groove around the wall of the last-mentioned axial bore when the stem 162 is fully inserted (see FIG. 10). In this position, the flat head 84 is substantially in engagement with the outer face of the end wall 136 of end cap 131 whilst the outer parts of the head 164 of the inner plug cooperate with the free edges, remote from the end wall 136, of the side walls 134 but do not project radially outwardly sufficiently to interfere with the insertion of the thus-assembled end cap assembly into the end of the slat extrusion.

A plurality of similar display devices may be arranged side by side and one above the other to form a composite display of very large size. In such a display, whilst the arrangement may be such that all of the units of the array may display, on their forwardly presented display surfaces, respective sections of the same picture or poster at any one time, the operation of the driving motors of the various units may be coordinated and controlled by computer for example, so that different devices in the array change over at different times, allowing complex and striking effects to be obtained, such as a "wave" or "chequered" changeover pattern.

As indicated above, display devices embodying the invention may be supplied to customers in the form of kits of parts, which the customers may assemble easily to provide desired display devices. In order to facilitate checking of such kits to ensure they contain the required components in the required number, and in order to facilitate packing, and further to provide a package which itself illustrates to customers or prospective customers the general appearance of the assembled display device and which illustrates the correct locations of the various components, the various components in such kits as packed for transport or storage are preferably assembled in a temporary disposable frame. Such a temporary frame may, for example, be an integral body of inexpensive plastics material, for example vacuum formed sheet plastics, which may be transparent, or of plastics foam, and may have opposing side formation which, at least as regards their internal surfaces, correspond in form, at least approximately, with the internal surfaces of the members 10*a* and 10*b*, the bearing members 20 being stacked in one such formation and the bearing members 16 stacked in the other, and with the slats 12 accomodated in a space defined between said formations and supported at their ends by the respective bearing members 16 and 20 in the same way as in the finally assembled display device. Alternatively the package for the kit of parts may simply comprise disposable temporary channels each supporting a stack of bearing members 20 or 16, with the other components being packed in positions other than those they would occupy in the assembled display device.

We claim:

1. A display device comprising an array of elongate slats of triangular section, means for mounting said slats for rotations about their respective longitudinal axes in synchronism in 120° steps so as to present to view, in a repeating cycle, comprising three display phases, three compound display surfaces, each presented to view during a respective one of said display phases, wherein each slat has a pair of end portions, the device further comprising means including a rotatable member having a non-circular formation for engagement with complementary formation carried by the slat at one of the end portions thereof for rotatably driving and supporting the slat, the display device further comprising a rotatable plug rotatably mounted in at least one of the end portions of the slat and including means for supporting said at least one slat end portion for rotation thereof, and the display device further comprising means for effecting rotational adjustment of said plug relative to the slat between predetermined angular positions at which said plug is angularly restrained relative to the slat for rotation therewith and with said plug being rotatable relative to the salt from one to another of said angular positions upon application of a predetermined rotatable force.

2. A display device according to claim 1 further comprising a sleeve, of complementary cross-section to that of the salt, which fits over the slat, said rotatable plug having a generally triangular head which, when rotated to angular locations between said angular positions, does not project beyond the side walls of the slat and which, in said angular positions, projects beyond the side walls of the slat to provide abutments, at the respective end portion of the slat, to engage an end of the sleeve and hold the sleeve captive on the slat.

3. A display device comprising a rectangular frame having two parallel side members, two parallel end members connecting said side members, an array of elongate slats of triangular section and each having a pair of end portions, means for mounting said slats, within said frame to extend between said side members and with longitudinal axes of said slats parallel with said end members, for rotation about the longitudinal axes of said slats in synchronism in 120° steps so as to present to view, in a repeating cycle, comprising three display phases, three compound display surfaces, each presented to view during a respective one of said display phases, a plurality of combined bearing and driving modules carried by one of said side members, a plurality of bearing modules carried by an other of said side members, each said slat being supported at one of said end portions thereof by a respective one of said combined bearing and driving modules and being supported at the opposite one of said end portions thereof by a respective one of said bearing modules carried by said other side member, each said combined bearing and driving module comprising a housing, a driving member, and a driven member, the housing having a pair of end walls which are spaced in the longitudinal direction of said one side member and a pair of aperture means in said end walls respectively which form bearings for said respective driving member, said driving member including portions which extend through said aperture means to form journals rotatable in the bearings formed by said aperture means, said driving member having an enlarged intermediate portion within the housing between said end walls, the housing further having a pair of side walls which are spaced apart in the longitudinal direction of the respective slat and a pair of aperture means in said side walls respectively which form bearings for said respective driven member, said driven member including portions which extend through said side wall aperture means to form journals rotatable in the bearings formed by said side wall aperture means, said driven member having an enlarged intermediate portion within the housing between said side walls, said enlarged portion of said driven member being in driven engagement with said enlarged portion of said respective driving member, one of said journal portions of said driven member and said one end portion of said slat having complementary non-circular engagement formation means for effecting driving engagement between said driven member and said slat such as to permit relative movement, in the longitudinal direction of the slat, between said slat and said one journal portion and such as to prevent relative rotatable movement of said slat relative to said one journal portion, each said driving member having passage means at least a portion of which is of uniform non-circular cross-section extending therethrough, a single unitary shaft, having a cross-section complementary to that of said passage means portion, extending longitudinally through said passage means of all of said driving members of the device, said shaft being co-axial with said driving members, said shaft being coupled with rotary motor means for driving said shaft for in turn driving said driving members, said combined driving and bearing modules abutting one another end-to-end in a series extending along said one side member and said opposite end portion bearing modules abutting one another end-to-end in a series extending along said other side member whereby the combined bearing and driving modules can be readily assembled and the slats can be individually fitted to or removed from the display device by releasing the slats from their respective combined bearing and driving modules, without significantly disturbing the remainder of the display device.

4. A device according to claim 3 further comprising plug and socket means for connecting said one end portion of each said slat with said respective combined bearing and driving module, and journal and bearing means for connecting said opposite end portion of each said slat with said respective bearing module, said slat including stop means for retaining said slat at said respective opposite end portion against axial displacement, said stop means being displaceable from an operative to an inoperative position to allow axial displacement of said slat relative to said one journal portion to disconnect said slat from said respective combined bearing and driving module and to permit subsequent withdrawal of said slat from the display device.

5. A display device according to claim 3 further comprising an assembly on said one end portion of each said slat including a rotatable plug having said non-circular formation for engagement with said complementary formation on said one journal portion of the driven member, said assembly further comprising means for effecting rotational adjustment of said plug relative to the slat between predetermined angular positions at which said plug is angularly restrained relative to the slat for rotation therewith and with said plug being rotatable relative to the slat from one to another of said angular positions upon application of a predetermined rotatable force.

6. A display device according to claim 5 wherein each said slat has three side walls, the display device further comprising another of said rotatable plug and another of said rotational adjustment means on said opposite end portion of said slat, a tubular sleeve, having a triangular cross-section which is complementary to that of said slat, which fits over said slat, said rotatable plugs on said one and said opposite end portions each having a generally triangular head which, when rotated to angular locations between said angular positions, does not project beyond said side walls of the slat and which, in said angular positions of said respective plug relative to said slat, does project beyond said side walls of said slat whereby, with the slat removed from the respective opposite end portion bearing module combined bearing and driving module, the sleeve can be slid longitudinally onto and off the slat when the plugs are in said angular locations in which their triangular heads do not project beyond the side walls of the slat and whereby, when the plugs are in said angular positions and their heads project beyond said side walls of the salt, the projecting portions of the heads provide abutments, at the respective end portions of the slat, to engage the ends of the respective sleeve and hold the sleeve captive on the slat.

7. A display device comprising a rectangular frame having two parallel side members, two parallel end members connecting said side members, an array of elongate slats of triangular section and each having a pair of end portions, means for mounting said slats, within said frame to extend between said side members and with longitudinal axes of said slats parallel with said end members, for rotation about the longitudinal axes of said slats in synchronism in 120° steps so as to present to view, in a repeating cycle, comprising three display phases, three compound display surfaces, each presented to view during a respective one of said display phases, a plurality of combined bearing and driving modules carried by one of said side members, a plurality of bearing modules carried by an other of said side members, each of said slats being rotatably supported at one of said end portions thereof by a respective one of said combined bearing and driving modules and being rotatably supported at an other of the end portions thereof by a respective one of said bearing modules carrier by said other side member, each said combined bearing and driving module comprising a housing, a driving member, and a driven member, said driving member including means for rotatably mounting said driving member in said housing, said combined driving and bearing modules abutting one another along said one side member, each said driving member including passage means at least a portion of which is of uniform non-circular cross-section, a single unitary shaft, having a cross-section which is complementary to that of said passage means portion, extending longitudinally and co-axially through said passage means of all of said driving members of the device, means for driving said shaft to in turn drive said driving members, said driven member including means for rotatably mounting said driven member in said housing co-axially with said respective slat and in driven engagement with said driving member, said driven member having a portion extending from said housing which portion has a non-circular cross-section, said one end portion of said respective slat having a passage which has a complementary cross-section to that of said driven member portion for coupling of said slat to said driven member whereby the driven member is in driving engagement with the respective slat and allows relative movement between the slat and the respective driven member in the longitudinal direction of the slat, stop means for retaining said slat against axial displacement from an operative position wherein the driven member is in driving engagement with the respective slat to an inoperative position wherein said one end portion of the slat is disengaged from the driven member portion to permit removal of the slat from the display device.

* * * * *